United States Patent [19]

El-Sayed et al.

[11] Patent Number: 5,002,848

[45] Date of Patent: Mar. 26, 1991

[54] SUBSTITUTED CARBOXYLIC ACIDS AS ADJUVANTS FOR POSITIVE ELECTROSTATIC LIQUID DEVELOPERS

[75] Inventors: Lyla M. El-Sayed, West Chester, Pa.; Loretta Ann G. Page, Newark; Kathryn A. Pearlstine, Wilmington, both of Del.

[73] Assignee: E. I. Du Pont de Nemours and Company, Wilmington, Del.

[21] Appl. No.: 408,222

[22] Filed: Sep. 5, 1989

[51] Int. Cl.[5] ..... G03G 9/00; G03G 5/00

[52] U.S. Cl. ..... 430/115; 430/137

[58] Field of Search ..... 430/115, 137

[56] References Cited

U.S. PATENT DOCUMENTS 3,888,678 6/1975 Bailey et al. ..... 96/87 A
4,891,286 1/1990 Gibson ..... 430/115

FOREIGN PATENT DOCUMENTS 0132718 2/1985 European Pat. Off. ..... 430/115
0139753 8/1982 Japan ..... 430/115

*Primary Examiner*—Marion E. McCamish
*Assistant Examiner*—S. Crossan

[57] ABSTRACT

A positive-working electrostatic liquid developer consisting essentially of (A) a nonpolar liquid having a Kauri-butanol value of less than 30, present in major amount, (B) thermoplastic resin particles, less than 10 μm average by area particle size, (C) a nonpolar liquid soluble ionic or zwitterionic charge director compound, and (D) a substituted carboxylic acid or salt adjuvant as defined. Component (D) can be present in liquid (A) or dispersed in the resin particles. The process of preparation of the electrostatic liquid developer is described. The liquid developers are useful in copying, color proofing including digital color proofing, lithographic printing plates and resists.

61 Claims, No Drawings

SUBSTITUTED CARBOXYLIC ACIDS AS ADJUVANTS FOR POSITIVE ELECTROSTATIC LIQUID DEVELOPERS

DESCRIPTION

1. Technical Field

This invention relates to electrostatic liquid developers. More particularly this invention relates to a positive-working liquid electrostatic developer containing resin particles having dispersed therein a substituted carboxylic acid.

2. Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0, and a high vapor pressure. The toner particles are less than 10 μm average by area size as determined using the Horiba centrifugal particle size analyzer or less than 30 μm average particle size as determined using a Malvern 3600E Particle Sizer, both described below. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, etc., to the liquid developer comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, poor solid area coverage (density), and/or non-uniform coverage. In order to overcome such problems much research effort has been expended to develop new type charge directors and/or charging adjuvants for electrostatic liquid toners or developers.

It has been found that the above disadvantages can be overcome and improved positive developers prepared containing a dispersant nonpolar liquid, ionic or zwitterionic charge director compound, a thermoplastic resin having dispersed therein an adjuvant of the invention, and preferably a colorant. The improved electrostatic liquid developer when used to develop an electrostatic image results in improved image quality, reduced squash, improved solid area coverage independent of any pigment and charge director compound present.

Such developer has good conductivity with improved mobility of the resin or toner particles.

DISCLOSURE OF THE INVENTION

In accordance with this invention there is provided a positive-working electrostatic liquid developer having improved charging characteristics consisting essentially (A) a nonpolar liquid having a Kauri-butanol value of less than 30, present in a major amount, (B) thermoplastic resin particles having an average by area particle size of less than 10 μm, (C) a nonpolar liquid soluble ionic or zwitterionic charge director compound, and (D) a substituted carboxylic acid adjuvant of the formula:

$$HO_2C—R—X_y$$

wherein R is alkyl of 1 to 500 carbon atoms, aryl of 6 to 30 carbon atoms, alkylaryl of 8 to 40 carbon atoms, X is a moiety selected from the group consisting of an electron withdrawing group wherein at least one such group is attached no more than 5 carbon atoms from the carbonyl carbon of the acid, a carboxylate anion-stabilizing moiety attached to the carbon atom adjacent to the carbonyl carbon of the acid group when R is alkyl, a carboxylate anion-stabilizing moiety attached to the carbon atom ortho to the carbon atom attached to the carbonyl carbon of the acid group when R is aryl, and combinations thereof, and y is an integer of 1 to 20; and salts of said acid.

In accordance with an embodiment of this invention there is provided a process for preparing a positive-working electrostatic liquid developer for electrostatic imaging comprising (A) dispersing at an elevated temperature in a vessel a thermoplastic resin, a dispersant nonpolar liquid having a Kauri-butanol value of less than 30, and a substituted carboxylic acid adjuvant of the formula:

$$HO_2C—R—X_y$$

wherein R is alkyl of 1 to 500 carbon atoms, aryl of 6 to 30 carbon atoms, alkylaryl of 8 to 40 carbon atoms, X is a moiety selected from the group consisting of an electron withdrawing group wherein at least one such group is attached no more than 5 carbon atoms from the carbonyl carbon of the acid, a carboxylate anion-stabilizing moiety attached to the carbon atom adjacent to the carbonyl carbon of the acid group when R is alkyl, a carboxylate anion-stabilizing moiety attached to the carbon atom ortho to the carbon atom attached to the carbonyl carbon of the acid group when R is aryl, and combinations thereof, and y is an integer of 1 to 20; and salts of said acid, while maintaining the temperature in the vessel at a temperature sufficient to plasticize and liquify the resin and below that at which the dispersant nonpolar liquid degrades and the resin and substituted carboxylic acid or salt of said acid decompose, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media, and (D) adding to the dispersion during or subsequent to Step (A) a nonpolar liquid soluble ionic or zwitterionic charge director compound.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvant, e.g., aminoalcohol, polybutylene succinimide, aromatic hydrocarbon, etc.

Aminoalcohol means there is both an amino functionality and a hydroxyl functionality in one compound.

Conductivity is the conductivity of the developer measured in picomhos (pmhos/cm) at 5 hertz and 5 volts.

Mobility means the movement of the resin or toner particles in the liquid electrostatic developer expressed in $m^2/Vsec$ ($X10^{-10}$) where V is volts.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isohydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| Norpar® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, and any pigment component present.

Useful thermoplastic resins or polymers include: copolymers of acrylic or methacrylic acid and at least one alkyl ester of acrylic or methacrylic acid wherein alkyl is 1–20 carbon atoms, or other acrylic resins including Elvacite® Acrylic Resins, E. I. du Pont de Nemours and Co., Wilmington, Del., ethylene vinyl acetate (EVA) copolymers (Elvax® resins, E. I. du Pont de Nemours and Company, Wilmington, Del.), copolymers of ethylene and an α,β-ethylenically unsaturated acid selected from the class consisting of acrylic acid and methacrylic acid, copolymers of ethylene (80 to 99.9%)/acrylic or methacrylic acid (20 to 0%)/alkyl (C1 to C5) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, Del., etc., or blends thereof, polyesters, polyvinyl toluene, polyamides, styrene copolymers, and modified resins disclosed in El-Sayed, Schmidt, Trout and Mitchell U.S. Pat. No. 4,798,778, the disclosure of which is incorporated herein by reference and epoxy resins. The synthesis of copolymers of ethylene and an α,β-ethylenically unsaturated acid of either acrylic acid or methacrylic acid is described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A.

Preferred resins include acrylic resins, such as methyl methacrylate (50–90%)/methacrylic acid (0–20%)/ethyl hexyl acrylate (10–50%).

In addition, the resins useful in the invention have the following preferred characteristics:

1. Be able to disperse the colorant, e.g., pigment, adjuvant, etc.
2. Be substantially insoluble in the dispersant liquid at temperatures below 40° C., so that the resin will not dissolve or solvate in storage,
3. Be able to plasticize at temperatures above 50° C. to form a homogeneous mixture with solvent,
4. Be able to be ground to form particles between 0.1 μm and 5 μm, in diameter (preferred size), e.g., determined by Horiba CAPA-500 centrifugal particle analyzer; and between 1 μm and 15 μm in diameter, e.g., determined by Malvern 3600E described below,
5. Be able to form a particle (average by area) of less than 10 μm, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and less than about 30 μm average particle size, e.g., determined by Malvern 3600E Particle Sizer as described below, and
6. Be able to fuse at temperatures in excess of 70° C.

By solvation in 3. above, the resins forming the toner particles will become swollen, or gelatinous, or softened.

Suitable nonpolar liquid soluble ionic or zwitterionic charge director compounds (C) which are used in an amount of 0.1 to 10,000 mg/g, preferably 1 to 1000 mg/g developer solids, include: positive charge directors, e.g., glyceride charge directors such as Emphos® D70-30C and Emphos® F27-85, two commercial products sold by Witco Chemical Corp., New York, N.Y.; which are sodium salts of phosphated mono- and diglycerides with unsaturated and saturated acid substituents respectively, lecithin, Basic Barium Petronate®, Neutral Barium Petronate®, Basic Calcium Petronate®, Neutral Calcium Petronate®, oil-soluble petroleum sulfonates, manufactured by Sonneborn Division of Witco Chemical Corp., supra, etc.

Substituted carboxylic acid adjuvants (D) useful in the invention include those compounds of the formula:

$$HO_2C—R—Xy$$

wherein R is alkyl of 1 to 500 carbon atoms, aryl of 6 to 30 carbon atoms and alkylaryl of 8 to 40 carbon atoms; X can be:

(1) an electron withdrawing group selected from the group consisting of CHO, CN, $NO_3$, Cl, Br, I, F, $SO_3H$, $CF_3$, $CO_2H$, $COR^1$, $CO_2R^1$, $N(R^1)_3+$, $SO_2R^1$, $CONR_2$, $CONH_2$, $CONHR^1$, $SO_2OR^1$, $NO_2$ wherein $R^1$ is alkyl of 1 to 40 carbon atoms, aryl of 6 to 30 carbon atoms and alkylaryl of 6 to 30 carbon atoms at least one electron withdrawing group being located no more than 5 carbon atoms from the carbonyl carbon of the acid group;

(2) a carboxylate anion-stabilizing moiety attached to the carbon atom adjacent to the carbonyl carbon of the acid group when R is alkyl, e.g., OH, SH, $SR^1$, wherein $R^1$ is alkyl of 1 to 40 carbon atoms, aryl of 6 to 30 carbon atoms, and alkylaryl of 6 to 30 carbon atoms;

(3) a carboxylate anion-stabilizing moiety attached to the carbon atom ortho to the carbon atom attached to the carbonyl carbon of the acid group when R is aryl, e.g., OH, SH, $SR^1$, wherein $R^1$ is alkyl of 1 to 40 carbon atoms, aryl of 6 to 30 carbon atoms, and alkylaryl of 6 to 30 carbon atoms; and combinations of (1), (2) and (3). y is an integer of 1 to 20. Salts of the substituted carboxylic acids are also useful as an adjuvant.

Examples of useful substituted carboxylic acids and their salts include:

where R is alkyl: dichloroacetic acid, 4-chlorobutyric acid, n-propyldicarboxylic acid, isopropyldicarboxylic acid, dimethyldicarboxylic acid, 3-chloropropionic acid, 2-bromopropionic acid, 2-iodopropionic acid, 3-cyanopropionic acid, cis-beta-chloroacrylic acid, poly(ethylhexylmethacrylate-comethacrylic acid), etc., and salts thereof;

where R is aryl: p-nitrobenzoic acid, m-nitrobenzoic acid, p-chlorobenzoic acid, m-chlorobenzoic acid, 4-chloro-1-napthoic acid, etc., and salts thereof;

where R is alkylaryl: pentadecyl salicylic acid, 2-chloro-4-methyl benzoic acid, phenyl succinic acid, etc. and salts thereof;

carboxylate anion-stabilizing moiety; salicylic acid, alpha-(n-propylthio)propionic acid, alpha(hydroxyacetic) acid, o-(ethylthio)-benzoic acid, etc., and salts thereof.

The substituted carboxylic acid and salt adjuvants are present in the developer in an amount of about 0.1 to 10% by weight, preferably about 1 to 5% by weight, based on the total weight of the developer solids. Methods whereby the substituted carboxylic acid and salt adjuvants are dispersed in the liquid electrostatic developer is described below.

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

Pigment List

| Pigment Brand Name | Manufacturer | Color Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |
| Hostaperm ® Orange GR | Hoechst | Orange 43 |

-continued

Pigment List

| Pigment Brand Name | Manufacturer | Color Index Pigment |
|---|---|---|
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black (Blackness Index 155) |

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used alone or in combination with the colorants. Metal particles can also be added.

Another additional component of the electrostatic liquid developer is an adjuvant which can be selected from the group consisting of aminoalcohol, polybutylene succinimide and aromatic hydrocarbon having a Kauributanol value of greater than 30. The adjuvants are generally used in an amount of 1 to 1000 mg/g, preferably 1 to 200 mg/g developer solids. Examples of the various above-described adjuvants include:

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, the disclosure of which is incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc. as described in Mitchell U.S. Pat. No. 4,663,264. The disclosure of these United States patents describing adjuvants are incorporated herein by reference.

The particles in the electrostatic liquid developer have an average by area particle size of less than 10 μm, preferably the average by area particle size is less than 5 μm. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The positive electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, substituted carboxylic acid or salt thereof of the invention as described, and dispersant polar liquid described above. Generally the resin, nonpolar liquid substituted carboxylic acid or salt adjuvant, and optional colorant are placed in the vessel prior to starting the dispersing step. Optionally the colorant can be added after homogenizing the resin and the dispersant nonpolar liquid. Polar liquid can also be present in the vessel, e.g., up to 100% based on the weight of total developer liquid. The dispersing step is generally accomplished at elevated temperature, i.e., the temperature of ingredients in the vessel being sufficient to plasticize and liquefy the resin but being below that at which the dispersant nonpolar liquid or polar liquid, if present, degrades and the resin, substituted carboxylic acid or salt of said acid and/or colorant, if present, decompose. A preferred temperature range is 80 to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to about 13 mm).

After dispersing the ingredients in the vessel, with or without a polar liquid present until the desired dispersion is achieved, typically 2 hours with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Additional liquid may be added at any step during the preparation of the liquid electrostatic toners to facilitate grinding or to dilute the toner to the appropriate % solids needed for toning. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature The resin precipitates out of the dispersant during the cooling Toner particles of average particle size (by area) of less than 10 μm, as determined by a Horiba centrifugal particle size analyzer or other comparable apparatus, are formed by grinding for a relatively short period of time.

Another instrument used to measure particle sizes is a Malvern 3600E Particle Sizer manufactured by Malvern, Southborough, MA which uses laser diffraction light scattering of stirred samples to determine average particle sizes. Since these two instrument use different techniques to measure average particle size the readings differ. The following correlation of the average size of toner particles in micrometers (μm) for the two instruments is:

| Value Determined By Malvern 3600E Particle Sizer | Expected Range for Horiba CAPA-500 |
|---|---|
| 30 | 9.9 + 3.4 |
| 20 | 6.4 + 1.9 |
| 15 | 4.6 + 1.3 |
| 10 | 2.8 + 0.8 |
| 5 | 1.0 + 0.5 |
| 3 | 0.2 + 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 10 percent by weight, preferably 0.3 to 3.0, and more preferably 0.5 to 2 weight percent with respect to the dispersant nonpolar liquid. One or more ionic or zwitterionic charge director compounds (C), of the type set out above, can be added to impart a positive charge. The addition may occur at any time during the process; preferably at the end of the process, e.g., after the particulate media, if used, are removed and the concentration of toner particles is accomplished. If a diluting dispersant nonpolar liquid is also added, the charge director compound can be added prior to, concurrently with, or subsequent thereto. If an adjuvant compound of a type described above has not been previously added in the preparation of the developer, it can be added prior to or subsequent to the developer being charged.

Other process embodiments for preparing the electrostatic liquid developer include:

(A) dispersing a thermoplastic resin, optionally a colorant, and/or a carboxylic acid or salt adjuvant of the invention in the absence of a dispersant nonpolar liquid having a Kauri-butanol value of less than 30 to form a solid mass.

(B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15 percent by weight with respect to the liquid; and (F) adding to the dispersion a nonpolar soluble ionic or zwitterionic charge director compound; and (A) dispersing a thermoplastic resin, optionally a colorant, and/or a carboxylic acid or salt adjuvant of the invention in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin, substituted carboxylic acid or salt of said acid, and/or colorant decompose, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15 percent by weight with respect to the liquid; and (G) adding to the dispersion a nonpolar soluble ionic or zwitterionic charge director compound.

INDUSTRIAL APPLICABILITY

The positive liquid electrostatic developers of this invention demonstrate improved image quality, resolution, solid area coverage (density), and toning of fine details, evenness of toning, and reduced squash independent of charge director or pigment present. The particles are exclusively charged positive. The developers of the invention are useful in copying, e.g., making office copies of black and white as well as various colors; or color proofing, e.g., a reproduction of an image using the standard colors: yellow, cyan, magenta together with black as desired; highlight color copying, e.g., copying of two colors, usually black and a highlight color for letterheads, underlining, etc. In copying and proofing the toner particles are applied to a latent electrostatic image and can be transferred, if desired. Other uses envisioned for the positive liquid electrostatic developers include: digital color proofing, lithographic printing plates and resists.

EXAMPLES

The following controls and examples wherein the parts and percentages are by weight illustrate but do not limit the invention. In the examples the melt indices are determined by ASTM D 1238, Procedure A; and the average particle sizes by area were determined by a Malvern 3600 Particle Size Analyzer, or the Horiba CAPA 500 centrifugal particle analyzer as described above; the conductivity was measured in picomhos (pmho)/cm at 5 Hertz and low voltage, 5 volts; and the density was measured using a Macbeth densitometer model RD 918. The resolution is expressed in the controls and Examples in line pairs/mm (lp/mm). Weight average molecular weight can be determined by gel permeation chromatography (GPC).

Image quality of the toners of the invention was determined on a modified Savin 870 copier unless specifically noted. This device consists of a Savin 870 copier with the modifications described below.

Mechanical modifications include addition of a pretransfer corona and removing the anodized layer from the surface of the reverse roll while decreasing the diameter of the roll spacers to maintain the same gap between the roll and photoconductor.

Electrical modifications include:

(1) disconnecting the image density feedback loop from the development electrode and connecting the electrode to a Keithly high voltage supply (model 247), (Keithly, Cleveland, Ohio)

(2) connecting a Keithly high voltage supply (model 247) to the modified reverse roll (3) disconnecting the transfer corona and connecting same to a Trek (model 610) high voltage supply, (Trek, Medina, N.Y.).

The modified Savin 870 was then used to evaluate both positive and negative toners depending on the voltages and biasses used. To evaluate positive toners the copier was run in a positive mode: reversed image target was used with negative transfer corona voltages and positive development bias. The reversed image target consists of white characters and lines, etc. on a black background.

The principal of operation is described below. The photoconductor is charged positive (near 1000V) by means of the charging corona. The copy is imaged onto the photoconductor inducing the latter to discharge to lower voltages (in order of increasing discharge-black areas and white areas). When adjacent to the toner electrode the photoconductor has fields at its surface such that positive toner will deposit at the white imaged areas, negative toner at the black imaged areas. If necessary toner background is removed by the biased reverse roll. The toner is then transferred to paper by the transfer corona (the transfer force due to the negative charge sprayed on the back of the paper). The toner is then thermally fused. Actual voltages and biases used can be found in the examples.

A control liquid developer containing no adjuvant was prepared as described in Control 1 below with the following exceptions: the amount of acrylic copolymer was 200 g and the amount of Isopar ®-L used was 1700 g. No Lubrizol ®2155 or pigment was added to the resin. The ingredients were ground hot for 1 5 hours and ground cold for 19.5 hours The other developers in the following table were prepared as described in Control 1 with the following exceptions: the amount of acrylic copolymer used was 40 g instead of 35 g, and 250 g of Isopar ®-L was added to the resin No Lubrizol ® 2155 or pigment was added to the resin The following adjuvants were used: p-toluic acid, 2 hour hot grind, 19.5 hour cold grind; barium salt of p-toluic acid, 2 hour hot grind, 17.5 hour cold grind; barium salt of p-nitrobenzoic acid, 2 hour hot grind, 21 hour cold grind; p-nitrobenzoic acid, 2 hour hot grind, 24 hour cold grind; p-chlorobenzoic acid, 2 hour hot grind, 19 hour cold grind; barium salt of p-chlorobenzoic acid, 2 hour hot grind, 16 hour cold grind; barium salt of p-nitrobenzoic acid, 2 hour cold grind, 21 hour cold grind; sodium salt of p-nitrobenzoic acid, 1.5 hour hot grind, 21.5 hour cold grind; ammonium salt of p-nitrobenzoic acid, 1.5 hour cold grind, 21.5 hour cold grind; 2-sulfobenzoic acid, 1.5 hour hot grind, 18.5 hour cold grind. The percentages given for adjuvants in Table 1 below are weight percent of the developer solids. The ingredients were removed from the attritor and diluted and charged as described in Table 1 below to form the developers. Adjuvants marked with asterisk (*) were not processed with the ingredients in the attritor, but were added in Isopar ® solution at the same time as the charge director.

The high frequency mobility of the toner particles in the liquid developer was measured using an electrokinetic sonic analysis instrument, Matec, Inc., Hopkinton, Mass. The instrument determines this mobility in $m^2/Vsec(X10^{-10})$. Mobility of the unpigmented toner particles of the liquid electrostatic developers was found to be higher than the controls. Increased mobility is one of the primary factors in improving developer performance.

In Table 1 mobility is given for particles charged by addition of Basic Barium Petronate ® (BBP) and Emphos ® phosphated glyceride sodium salt (Emp). The conductivity is for the bulk toner suspension and is in pmhos/cm. The charge director levels are given as milligrams of surfactant per gram of developer solids.

TABLE 1

| ADJUVANT | CHARGE DIRECTOR | CONDUCTIVITY (pmhos/cm) | Mobility |
|---|---|---|---|
| No adjuvant (Control A) | 120 mg/g BBP | 161 | 0.87 |
| No adjuvant (Control B) | 30 mg/g BBP | 22 | 0.57 |
| No adjuvant (Control C) | 300 mg/g Emp | 153 | 5.9 |
| No adjuvant (Control D) | 50 mg/g Emp | 24 | 4.1 |
| p-toluic acid 2.23% (Control E) | 120 mg/g BBP | 107 | −1.2 |
| p-toluic acid, 2.23% (Control F) | 300 mg/g Emp | 160 | 4.5 |
| Barium salt of p-toluic acid, 2.15% (Control G) | 120 mg/g BBP | 137 | 2.8 |
| Barium salt of p-toluic acid, 2.15% (Control H) | 300 mg/g Emp | 181 | 0.65 |
| Barium salt of p-nitrobenzoic acid, 2.47% (Control I) | none | 0 | 1.55 |
| Copolymer of ethyl hexyl methacrylated/methacrylic acid (40/8), 127 mg/g (Control J)* | none | 1 | 0.69 |
| p-nitrobenzoic acid 1.46% | 120 mg/g BBP | 482 | 14.5 |
| p-nitrobenzoic acid 1.46% | 300 mg/g Emp | 185 | 11.3 |

TABLE 1-continued

| ADJUVANT | CHARGE DIRECTOR | CONDUCTIVITY (pmhos/cm) | Mobility |
|---|---|---|---|
| p-chlorobenzoic acid 1.37% | 120 mg/g BBP | 140 | 14.4 |
| p-chlorobenzoic acid 1.37% | 300 mg/g Emp | 153 | 9.6 |
| Barium salt of p-chlorobenzoic acid, 2.36% | 120 mg/g BBP | 135 | 7.3 |
| Barium salt of p-chlorobenzoic acid, 2.36% | 300 mg/g Emp | 192 | 10 |
| Barium salt of p-nitrobenzoic acid, 2.47% | 120 mg/g BBP | 225 | 9.4 |
| Barium salt of p-nitrobenzoic acid, 2.47% | 300 mg/g Emp | 218 | 8.7 |
| Sodium salt of p-nitrobenzoic acid, 3% | 120 mg/g BBP | 352 | 14 |
| Sodium salt of p-nitrobenzoic acid, 3% | 300 mg/g Emp | 226 | 11.5 |
| Ammonium salt of p-nitrobenzoic acid, 3% | 60 mg/g BBP | 244 | 12.1 |
| Ammonium salt of p-nitrobenzoic acid, 3% | 300 mg/g Emp | 215 | 12.3 |
| 4-pentadecyl salicylic acid, 2.5%* | 120 mg/g BBP | 100 | 4.8 |
| 2-sulfobenzoic acid, 3.1% | 50 mg/g Emp | 40 | 6.5 |
| Copolymer of ethyl methacrylate/methacrylic acid (40/8), 127 mg/g* | 127 mg/g BBP | 85 | 3.21 |

CONTROL 1

In a Union Process 01 Attritor, Union Process Company, Akron, Ohio was placed the following ingredients:

| INGREDIENT | AMOUNT (GMS) |
|---|---|
| Terpolymer of methyl methacrylate (67%), methacrylic acid (3%), and ethyl hexyl acrylate (30%), weight average molecular weight of 172,000, acid number is 13 | 35 |
| Heucophthal Blue G (Heubach Inc., Newark, NJ) | 8.97 |
| Lubrizol ® 2155 oil-soluble amino surfactant, Lubrizol Co., Wickliffe, OH | 5 |
| Isopar ®-L, nonpolar liquid having a Kauri-butanol value of 27, Exxon Corporation | 200 |

All ingredients except the Lubrizol® 2155 were heated to 90° C. to 110° C. in the Union 01 attritor and milled with 0.1875 inch (4.76 mm) diameter stainless steel balls for one hour. The attritor was cooled to 42° C. to 50° C. while milling was continued. Milling was continued and average particle size was monitored. When the particle size leveled off (at 1.6 μm), Lubrizol® 2155 was added and milling was continued and particle size monitored. Particle size by area measured with the Horiba instrument was 0.84 μm, corresponding to a 10 hour cold grind. The particulate media were removed and the developer was diluted to 1% solids with additional Isopar®-L. To 1.5 kg of the dispersion were added 30 grams of a 5% solution of Emphos®D-70-30C in Isopar®-L. (100 mg per gram toner solids). The resulting toner had a conductivity of 23 pmhos/cm. Image quality was determined using a modified Savin 870 set up to evaluate positive toners. The development housing bias was +600 V and the transfer corona was −6.0 kV. Image density in the solid areas was non-uniform, with a maximum density of 1.44. The image resolution was 6 lp/mm. The average mobility of the toner particles in the developer was measured as $6X-10^{10}m^2/Vsec$.

CONTROL 2

The procedure of Control 1 was repeated with the following exceptions: the amount of acrylic terpolymer used was 40 g instead of 35 g, and 10.28 grams of the magenta pigment described in Control 2 was used instead of 8.97 g of Heucophthal blue. No Lubrizol® 2155 was used. Instead of 200 g Isopar®-L, 250 g were used. In addition 1.03 grams of benzoic acid, lot #00103JM, Aldrich Chemical Co., Milwaukee, WI were added initially. The toner was cold ground for 21.5 hours with a final Malvern instrument particle size of 3.7 μm. The final conductivity of the diluted toner was 11 pmhos/cm. The solids were non-uniform with a maximum density of 0.87 and the image showed 7 lp/mm. The measured average particle mobility was $1.2\times10^{10}m^2/Vsec$.

CONTROL 3

The procedure of Control 1 was followed with the following exceptions: the amount of acrylic terpolymer used was 40 g instead of 35 g, and 250 g Isopar®-L were used instead of 200 g. No Lubrizol® 2155 or pigment was added to the resin. Total grind time was 25.5 hours. Emphos®D70-30C charge director was used and the developer had a conductivity of 27 pmhos/cm. The image was evaluated using the modified Savin copier with a development bias of +600 V and a transfer voltage of −6.0 kV. The image gave uniform solids and a resolution of 6 lp/mm. The measured average particle mobility was $5\times10^{10}m^2/Vsec$.

CONTROL 4

The procedure of Control 3 was followed with the following exception: 0.82 grams of benzoic acid were added initially. The developer was cold ground for 20 hours for a final Malvern instrument particle size of 11.4 μm. The developer was charged with Emphos®D-70-30C and had a conductivity of 18 pmhos/cm. When evaluated on the modified Savin copier as described in Control 4, the resulting image showed more pick-off in solid areas than Control 4 and a resolution of 6 lp/mm. The measured average particle mobility was $3\times10^{10}m2/Vsec$.

CONTROL 5

The procedure of Control 3 was repeated with the following exception: 1 4% vinyl acetic acid was added initially in the hot grind. The developer was cold ground for 21.5 hours for a final Malvern instrument average particle size of 7.7 μm. The conductivity of the developer after addition of Emphos®D70-30C was 18 pmhos/cm. The image showed uniform solid areas and a resolution of 5 lp/mm at a development voltage=1000 volts and −6 kV transfer bias. The measured average particle mobility was $4.6\times10^{-10}m^2/Vs$.

EXAMPLE 1

The procedure of Control 1 was repeated with the following exception: 0.9 g 4-nitrobenzoic acid (Aldrich Chemical Company, Milwaukee, Wis.) was added to the attritor prior to the hot grinding step. The developer was charged with Emphos®D70-30C and had a conductivity of 50 pmhos/cm. The developer was evaluated on the modified Savin copier as described in Control 1. In the resulting image, the solid areas were much more uniform, with a density of 1.28. Resolution was 10 lp/mm. The measured average particle mobility was $10.1\times10^{-10}m^2/Vsec$.

EXAMPLE 2

The procedure of Control 2 was repeated with the following exception: instead of benzoic acid, 1.03 grams of 4-nitrobenzoic acid were added initially. The average particle size as measured on the Malvern instrument was 3.5 μm. The final developer had a conductivity of 10 pmhos/cm. In the image, the solid areas were much more uniform and had a maximum density of 1.22. The resolution was also improved to 8.5 lp/mm. The measured average particle mobility was $6.3\times10^{-10}m^2/Vsec$.

EXAMPLE 3

The procedure of Control 3 was repeated with the following exceptions: 1.12 grams of 4-nitrobenzoic acid were added initially. The developer was cold ground for 22.5 hours for a final Malvern instrument average particle size of 8.6 μm. The conductivity of the developer which was charged with Emphos ®D70-30C was 22 pmhos/cm. The image was evaluated as in Control 3 and showed uniform solid areas and a resolution of 8.5 lp/mm. The measured average particle mobility was 8.5 $\times10^{-10}m^2/Vsec$.

EXAMPLE 4

The procedure of Control 3 was repeated with the following exceptions: 2% 4-chlorobutyric acid was added initially in the hot grind. The developer was cold ground for hours for a final Malvern instrument average particle size of 10.6 μm. The conductivity of the developer was 25 pmhos/cm after addition of Emphos ®D-70-30C. The image was evaluated at +1000 volts development bias and −6 kV transfer bias and showed uniform solid areas and a resolution of 8.5 lp/mm. The measured average particle mobility was $6.7\times10^{-10}m^2/Vsec$.

EXAMPLE 5

Three developers were prepared using the procedure outlined below:

| INGREDIENT | AMOUNT (g) |
|---|---|
| Terpolymer of methyl methacrylate (67%)/methacrylic acid (3%) ethyl hexyl acrylate (30%), weight average molecular weight of 172,000, acid number is 13 | 40 |
| Isopar ®-L, nonpolar liquid having a Kauri-butanol value of 27, Exxon Corporation | 250 |

The above ingredients were placed in a Union Process 01 Attritor, Union Process Company, Akron, Ohio, heated at 90° C. to 110° C. and milled with 0.1875 inch (4.76 mm) diameter stainless steel balls for one hour. The attritor was cooled to 42° C. to 50° C. while milling was continued and average particle size was monitored. Particle size measured with Horiba was 0.84 μm by area, corresponding to a 25.5 hour cold grind. The particulate media were removed and the toner was diluted to 1% solids with additional Isopar ®-L.

To 1.5 kg of the dispersion prepared above, was added Basic Barium Petronate ®(127 mg per gram of developer solids) (Sample A).

To 1.5 kg of the dispersion prepared above, was added Basic Barium Petronate ®(127 mg per gram of developer solids) and a 10% solution of a copolymer of ethyl hexyl methacrylate/methacrylic acid (40/8 parts) in Isopar ®-L (127 mg per gram of developer solids) (Sample B).

To 1.5 kg of the dispersion prepared above, was added a 10% solution of a copolymer of ethyl hexyl methacrylate/methacrylic acid (40/8 parts) in Isopar ®-L (127 mg per gram of toner solids) (Sample C).

The resulting developers had the conductivities and mobilities as set out below.

| SAMPLE | CONDUCTIVITY (pmhos/cm) | MOBILITY ($\times 10^{-10} m^2/Vsec$) |
|---|---|---|
| A (Control) | 110 | 0.7 |
| B | 85 | 2 3 |
| C (Control) | 1 | 0.5 |

EXAMPLE 6

The following ingredients were placed in a Union Process IS Attritor, Union Process Company, Akron, Ohio:

| INGREDIENT | AMOUNT (g) |
|---|---|
| Copolymer of ethylene (89%)/ methacrylic acid (11%) melt index at 190° C. is 100, acid no. is 66 | 270 |
| Heliogen ® Blue K 7010 (BASF Corp., Holland, MI) | 30 |
| Isopar ®-L, nonpolar liquid having a Kauri-butanol value of 27, Exxon Corporation | 1640 |

The ingredients were heated to 100° C.+/−10° C. in the attritor and milled with 0.1875 inch (4.76 mm) diameter stainless steel balls for 1 hour. The attritor was cooled to 42° C. to 50° C. while the milling was continued for 4 hours to obtain toner particles with an average particle size of 6.5 μm measured with a Malvern 3600E particle size analyzer. The particulate media were removed, and the dispersion of toner particles was then diluted to 2 percent solids with additional Isopar ®-L. The developer formed was charged with Neutral Basic Petronate ®(333 mg/g of developer solids). Dichloroacetic acid (DCAA) was then added in the amounts shown below. Conductivity and mobility data are also shown below.

| DCAA (%) | CONDUCTIVITY (pmhos/cm) | MOBILITY ($\times 10^{-10} m^2/Vsec$) |
|---|---|---|
| None | 200 | 1.97 |
| 1 | 129 | 4.7 |
| 5 | 202 | 6.63 |

We claim:

1. A positive-working electrostatic liquid developer having improved charging characteristics consisting essentially of (A) a nonpolar liquid having a Kauri-butanol value of less than 30, present in a major amount, (B) thermoplastic resin particles charged positive having an average by area particle size of less than 10 μm, (C) a nonpolar liquid soluble ionic or zwitterionic charge director compound, and (D) a substituted carboxylic acid adjuvant of the formula:

$HO_2C—R—X_y$ wherein R is alkyl of 1 to 500 carbon atoms, aryl of 6 to 30 carbon atoms, alkylaryl of 8 to 40 carbon atoms, X is a moiety selected from the group consisting of an electron withdrawing group wherein at least one such group is attached no more than 5 carbon atoms from the carbonyl carbon of the acid, a carboxylate anion-stabilizing moiety attached to the carbon atom adjacent to the carbonyl carbon of the acid group when R is alkyl, a carboxylate anion-stabilizing moiety attached to the carbon atom ortho to the carbon atom attached to the carbonyl carbon of the acid group when R is aryl, and combinations thereof, and y is an integer of 1 to 20; and salts of said acid.

2. An electrostatic liquid developer according to claim 1 wherein X is an electron withdrawing group.

3. An electrostatic liquid developer according to claim 2 wherein X is an electron withdrawing group selected from the group consisting of CHO, CN, $NO_3$, Cl, Br, I, F, $SO_3H$, $CF_3$, $CO_2H$, $COR^1$, $CO_2R^1$, $N(R^1)_3+$, $SO_2R^1$, $CONR^2{}_1$, $CONH_2$, $CONHR^1$, $SO_2OR^1$, $NO_2$ wherein $R^1$ is alkyl of 1 to 40 carbon atoms, aryl of 6 to 30 carbon atoms and alkylaryl of 6 to 30 carbon atoms.

4. An electrostatic liquid developer according to claim 1 wherein the substituted carboxylic acid adjuvant is a substituted aromatic carboxylic acid having 6 to 30 carbon atoms.

5. An electrostatic liquid developer according to claim 4 wherein the substituted carboxylic acid adjuvant is p-nitrobenzoic acid.

6. An electrostatic liquid developer according to claim 4 wherein the substituted carboxylic acid adjuvant is p-chlorobenzoic acid.

7. An electrostatic liquid developer according to claim 4 wherein the substituted carboxylic acid adjuvant is salicylic acid.

8. An electrostatic liquid developer according to claim 1 wherein the substituted carboxylic acid adjuvant is a substituted aliphatic carboxylic acid having 1 to 500 carbon atoms.

9. An electrostatic liquid developer according to claim 8 wherein the substituted carboxylic acid adjuvant is 4-chlorobutyric acid.

10. An electrostatic liquid developer according to claim 8 wherein the substituted carboxylic acid adjuvant is dichloroacetic acid.

11. An electrostatic liquid developer according to claim 1 wherein the substituted carboxylic acid adjuvant is a salt of a substituted aromatic carboxylic acid having 6 to 30 carbon atoms.

12. An electrostatic liquid developer according to claim 11 wherein the carboxylic acid salt adjuvant is the barium salt of p-nitrobenzoic acid.

13. An electrostatic liquid developer according to claim 1 wherein the substituted carboxylic adjuvant is a substituted alkylaryl carboxylic acid having 8 to 40 carbon atoms.

14. An electrostatic liquid developer according to claim 13 wherein the substituted carboxylic acid adjuvant is 4-pentadecyl salicylic acid.

15. An electrostatic liquid developer according to claim 1 wherein the substituted carboxylic acid adjuvant (D) is dispersed in the resin particles.

16. An electrostatic liquid developer according to claim 1 wherein component (A) is present in 85 to 99.9% by weight, based on the total weight of the liquid developer, the total weight of developer solids is 0.1 to 15% by weight, the substituted carboxylic acid or salt adjuvant (D) being present in the developer solids in an amount of about 0.1 to 10 percent by weight based on the total weight of developer solids, and component (C) is present in an amount of 0.1 to 10,000 mg/g developer solids.

17. An electrostatic liquid developer according to claim 1 containing up to about 60% by weight of a colorant based on the total weight of developer solids.

18. An electrostatic liquid developer according to claim 17 wherein the colorant is a pigment.

19. An electrostatic liquid developer according to claim 17 wherein the colorant is a dye.

20. An electrostatic liquid developer according to claim 1 wherein a fine particle size oxide is present.

21. An electrostatic liquid developer according to claim 1 wherein an additional compound is present which is an adjuvant selected from the group consisting of aminoalcohol, polybutylene succinimide, and an aromatic hydrocarbon.

22. An electrostatic liquid developer according to claim 17 wherein an additional compound is present which is an adjuvant selected from the group consisting of aminoalcohol, polybutylene succinimide, and an aromatic hydrocarbon.

23. An electrostatic liquid developer according to claim 21 wherein an aminoalcohol adjuvant compound is present.

24. An electrostatic liquid developer according to claim 21 wherein a polybutylene succinimide adjuvant compound is present.

25. An electrostatic liquid developer according to claim 21 wherein an aromatic hydrocarbon adjuvant compound having a Kauri-butanol value of greater than 30 is present.

26. An electrostatic liquid developer according to claim 1 wherein the thermoplastic resin component (B) is a copolymer of at least one alkyl ester of acrylic or methacrylic acid wherein alkyl is 1 to 20 carbon atoms and optionally acrylic or methacrylic acid.

27. An electrostatic liquid developer according to claim 26 wherein the thermoplastic resin component is a copolymer of methyl methacrylate (50–90%)/methacrylic acid (0–20%)/ethyl hexyl acrylate (10–50%).

28. An electrostatic liquid developer according to claim 27 wherein the thermoplastic resin component is a copolymer of methyl methacrylate (67%)/methacrylic acid (3%)/ethyl hexyl acrylate (30%).

29. An electrostatic liquid developer according to claim 1 wherein the thermoplastic resin component is a copolymer of ethylene (89%)/methacrylic acid (11%) having a melt index at 190° C. of 100.

30. An electrostatic liquid developer according to claim 1 wherein the particles have an average particle size by area of less than 5 μm.

31. An electrostatic liquid developer according to claim 1 wherein component (C) is a salt of phosphated mono- and diglycerides with unsaturated or saturated acid substituents.

32. An electrostatic liquid developer according to wherein component (C) is an oil-soluble petroleum sulfonate.

33. An electrostatic liquid developer according to claim 1 wherein the resin particles have a plurality of fibers integrally extending therefrom.

34. A process for preparing a positive-working electrostatic liquid developer for electrostatic imaging comprising (A) dispersing at an elevated temperature in a vessel a thermoplastic resin, a dispersant nonpolar liquid having a Kauri-butanol value of less than 30, and a substituted carboxylic acid adjuvant of the formula:

$HO_2C—R—Xy$ wherein R is alkyl of 1 to 500 carbon atoms, aryl of 6 to 30 carbon atoms, alkylaryl of 8 to 40 carbon atoms, X is a moiety selected from the group consisting of an electron withdrawing group wherein at least one such group is attached no more than 5 carbon atoms from the carbonyl carbon of the acid, a carboxylate anion-stabilizing moiety attached to the carbon atom adjacent to the carbonyl carbon of the acid group when R is alkyl, a carboxylate anion-stabilizing moiety attached to the carbon atom ortho to the carbon atom attached to the carbonyl carbon of the acid group when R is aryl, and combinations thereof, and y is an integer of 1 to 20; and salts of said acid, while maintaining the temperature in the vessel at a temperature sufficient to plasticize and liquify the resin and below that at which the dispersant nonpolar liquid degrades and the resin and substituted carboxylic acid or salt of said acid decompose, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media, and (D) adding to the dispersion during or subsequent to Step (A) a nonpolar liquid soluble ionic or zwitterionic charge director compound.

35. A process according to claim 34 wherein the substituted carboxylic acid adjuvant is a substituted aromatic carboxylic acid having 6 to 30 carbon atoms 36. A process according to claim 35 wherein the substituted carboxylic acid adjuvant is p-nitrobenzoic acid.

37. A process according to claim 35 wherein the substituted carboxylic acid adjuvant is p-chlorobenzoic acid.

38. A process according to claim 35 wherein the substituted carboxylic acid adjuvant is salicylic acid.

39. A process according to claim 34 wherein the substituted carboxylic acid adjuvant is a substituted aliphatic carboxylic acid having 1 to 500 carbon atoms.

40. A process according to claim 39 wherein the substituted carboxylic acid adjuvant is 4-chlorobutyric acid.

41. A process according to claim 39 wherein the substituted carboxylic acid adjuvant is dichloroacetic acid.

42. A process according to claim 34 wherein the substituted carboxylic acid adjuvant is a salt of a substituted aromatic carboxylic acid having 6 to 30 carbon atoms.

43. A process according to claim 42 wherein the carboxylic acid salt adjuvant is the barium salt of p-nitrobenzoic acid.

44. A process according to claim 34 wherein there is present in the vessel up to 100% by weight of a polar liquid having a Kauri-butanol value of at least 30, the percentage based on the total weight of the developer liquid.

45. A process according to claim 34 wherein the particulate media are selected from the group consisting of stainless steel, carbon steel, ceramic, alumina, zirconia, silica and sillimanite.

46. A process according to claim 34 wherein the thermoplastic resin component (B) is a copolymer of at least one alkyl ester of acrylic or methacrylic acid wherein alkyl is 1 to 20 carbon atoms and optionally acrylic or methacrylic acid.

47. A process according to claim 46 wherein the thermoplastic resin component is a copolymer of methyl methacrylate (50–90%)/methacrylic acid (0–20%)/ethyl hexyl acrylate (10–50%).

48. A process according to claim 47 wherein the thermoplastic resin component is a copolymer of methyl methacrylate (67%)/methacrylic acid (3%)/ethyl hexyl acrylate (30%).

49. A process according to claim 34 wherein the thermoplastic resin component is a copolymer of ethylene (89%)/methacrylic acid (11%) having a melt index at 190° C. of 100.

50. A process according to claim 34 wherein the charge director compound is a salt of phosphated mono and diglycerides with unsaturated or saturated acid substituents.

51. A process according to claim 34 wherein the charge director compound is an oil-soluble petroleum sulfonate.

52. A process according to claim 34 wherein additional dispersant nonpolar liquid, polar liquid, or combinations thereof is present to reduce the concentration of toner particles to between 0.1 to 15 percent by weight with respect to the developer liquid.

53. A process according to claim 52 wherein the concentration of toner particles is reduced by additional dispersant nonpolar liquid.

54. A process according to claim 34 wherein cooling the dispersion is accomplished while grinding by means of particulate media to prevent the formation of a gel or solid mass with or without the presence of additional liquid.

55. A process according to claim 34 wherein cooling the dispersion is accomplished without stirring to form a gel or solid mass, followed by shredding the gel or solid mass and grinding by means of particulate media with o without the presence of additional liquid.

56. A process according to claim 34 wherein cooling the dispersion is accomplished with stirring to form a viscous mixture and grinding by means of particulate media with or without the presence of additional liquid.

57. A process according to claim 34 wherein an adjuvant compound selected from the group consisting of aminoalcohol, polybutylene succinimide, and an aromatic hydrocarbon is added during the dispersing step (A).

58. A process according to claim 57 wherein the adjuvant compound is an aminoalcohol.

59. A process according to claim 52 wherein an adjuvant compound selected from the group consisting of aminoalcohol, polybutylene succinimide, and an aromatic hydrocarbon is added.

60. A process for preparing electrostatic liquid developer comprising (A) dispersing a thermoplastic resin, optionally a colorant, and/or a substituted carboxylic acid adjuvant of the formula $HO_2C—R—Xy$ wherein R is alkyl of 1 to 500 carbon atoms, aryl of 6 to 30 carbon atoms, alkylaryl of 8 to 40 carbon atoms, X is a moiety selected from the group consisting of an electron withdrawing group wherein at least one such group is attached no more than 5 carbon atoms from the carbonyl carbon of the acid, a carboxylate anion-stabilizing moiety attached to the carbon atom adjacent to the carbonyl carbon of the acid group when R is alkyl, a carboxylate anion-stabilizing moiety attached to the carbon atom ortho to the carbon atom attached to the carbonyl carbon of the acid group when R is aryl, and combinations thereof, and y is an integer of 1 to 20; and salts of said acid, in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15 percent by weight with respect to the liquid; and (F) adding to the dispersion a liquid soluble ionic or zwitterionic charge director compound.

61. A process for preparing electrostatic liquid developer comprising (A) dispersing a thermoplastic resin, optionally a colorant and/or a substituted carboxylic acid adjuvant of the formula $HO_2C—R—Xy$ wherein R is alkyl of 1 to 500 carbon atoms, aryl of 6 to 30 carbon atoms, alkylaryl of 8 to 40 carbon atoms, X is a moiety selected from the group consisting of an electron withdrawing group wherein at least one such group is attached no more than 5 carbon atoms from the carbonyl carbon of the acid, a carboxylate anion-stabilizing moiety attached to the carbon atom adjacent to the carbonyl carbon of the acid group when R is alkyl, a carboxylate anion-stabilizing moiety attached to the carbon atom ortho to the carbon atom attached to the carbonyl carbon of the acid group when R is aryl, and combinations thereof, and y is an integer of 1 to 20; and salts of said acid, in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding additional nonpolar liquid, polar liquid, or combinations thereof to reduce the concentration of toner particles to between 0.1 to 15 percent by weight with respect to the developer liquid; and (G) adding to the dispersion a liquid soluble ionic or zwitterionic charge director compound.

* * * * *